US005663755A

United States Patent [19]

Wada et al.

[11] Patent Number: 5,663,755

[45] Date of Patent: Sep. 2, 1997

[54] COLOR IMAGE FORMING APPARATUS

[75] Inventors: Koji Wada, Kanagawa; Yoshiharu Sasaki, Shizuoka, both of Japan

[73] Assignee: Fuji Photo Film Co., Ltd., Kanagawa, Japan

[21] Appl. No.: 404,652

[22] Filed: Mar. 14, 1995

[30] Foreign Application Priority Data

Mar. 25, 1994 [JP] Japan ..... 6-056017

[51] Int. Cl.[6] ..... B41J 2/325

[52] U.S. Cl. ..... 347/176; 347/213

[58] Field of Search ..... 347/213, 171, 347/212, 172, 174, 176; 400/120.01, 120.02

[56] References Cited

U.S. PATENT DOCUMENTS

| | | | |
|---|---|---|---|
| 4,891,655 | 1/1990 | Watanabe | 346/151 |
| 5,352,562 | 10/1994 | Takahashi et al. | 347/171 |
| 5,534,905 | 7/1996 | Takahashi et al. | 347/171 |

FOREIGN PATENT DOCUMENTS

| | | | |
|---|---|---|---|
| 0529562 | 3/1993 | European Pat. Off. | B41M 5/38 |
| 5254188 | 10/1993 | Japan | B41J 11/02 |

OTHER PUBLICATIONS

Patent Abstracts of Japan, vol. 18, No. 13 (M-1539) Jan. 11, 1994, & JP-A-05 254 188 (Konica Corp.) Oct. 5, 1993 *abstract.

Patent Abstracts of Japan, vol. 17, No. 524 (M-1483) Sep. 21, 1993, & JP-A-05 138 959 (Konica Corp.) Jun. 8, 1993 *abstract.

Patent Abstracts of Japan, vol. 11, No. 180 (M-597) Jun. 10, 1987, and JP-A-62 009 975 (Sharp Corp.) Jan. 17, 1987 *abstract.

*Primary Examiner*—Huan H. Tran

*Attorney, Agent, or Firm*—Sughrue, Mion, Zinn, Macpeak & Seas

[57] ABSTRACT

The improved color image forming apparatus comprises a rotating member for rotationally scanning and transporting both an image-receiving material having an image-receiving layer and a colorant sheet having a peelable, thin colorant film, a holder for holding at least the image-recieving material on the rotating member, a lamenator for pressing the colorant sheet so that it adheres to the image-receiving material, a recording device for applying thermal energy to the image-receiving material and the colorant sheet, and a peel/transfer mechanism by which the colorant sheet that has been imagewise supplied with thermal energy by the recording device is peeled for transfer to form a monochromatic image on the image-receiving material. This procedure of monochromatic image formation is repeated for three or four colors to produce a full color image. The apparatus is compact and yet is capable of forming high-quality image while assuring that the colorant sheet can be adhered to or peeled from the image-receiving material uniformly without causing failure in registration, particularly without causing unevenness during peeling.

6 Claims, 5 Drawing Sheets

10
12
14
16
17
18
19
20
22
23
24a
24b
26
28

COLOR IMAGE FORMING APPARATUS

BACKGROUND OF THE INVENTION

This invention relates to an apparatus that forms color images by repeating the process of applying thermal energy imagewise to a colorant sheet having a thin film of colorant and then transferring the imagewise pattern of thin colorant film onto an image-receiving material from the other part of the colorant sheet by peel/transfer. More specifically, the invention relates to a color image forming apparatus that prepares direct digital color proofs for use in the printing area by image recording with lasers or thermal heads in response to digital image signals.

Thermal printers, or apparatus that form images by heat transfer recording, have heretofore been proposed. A thermal head furnished with a number of heat generating elements is pressed against an image-receiving sheet via an ink sheet and the heat generating elements are selectively activated to generate heat in response to an image signal. The ink transfer layer in the ink sheet is discretely softened, melted vaporized or sublimed so that the ink is transferred in dots onto the image-receiving sheet, whereby the image is recorded.

The selective heating of the ink sheet in response to an image signal in the heat transfer recording method may be effected by laser-emitted light of high-density energy and this method has been proposed as "laser recording" in a heating mode.

In heat transfer recording by either a thermal head or a laser operating in a heating mode, color images can be produced by performing multiple transfer recording on an image-receiving sheet from an ink sheet or ink sheets with three colors, yellow (Y), magenta (M) and cyan (C), or four colors, Y, M, C and K (black), to produce one print. If necessary, the time of electric current application to the heat generating elements in the thermal head or to the laser, hence, the time of heat generation by the thermal head or the time of light emission from the laser, may be controlled so as to modulate the amount or area of the ink that is to be softened,or melted or which is to be vaporized or sublimed, whereby either the ink density or the area of halftone (dots) is modulated to produce density gradations in individual pixels.

The basic layout of a prior art apparatus for forming images by the above-described method of heat transfer recording is shown in FIG. 5. The apparatus generally indicated by 100 in FIG. 5 performs heat transfer image recording by means of a thermal head 112. The image-receiving sheet 102 is held by a clamper (not shown) onto a timing belt 106 that is wound around a belt drive roller 103 that is motor driven, a platen roller 104 and an idle roller 105 and it is transported as the platen roller 104 rotates.

An ink sheet 110 is unwound from a supply roll 111 and brought into a superposed relationship with the image-receiving sheet 102 on the platen roller 104. The ink sheet is thereafter heated imagewise by means of a thermal head 112 provided in close proximity to the platen roller 104, whereupon the ink layer in the ink sheet 110 melts or sublimes to be transferred imagewise onto the image-receiving sheet 102 for image recording. Subsequently, the used ink sheet 110 is wound up by a takeup roll 113 and the image-receiving sheet 102 is returned to the recording start position. This image recording procedure is taken as many times as are required to record three or four colors (including the number of times required for any special colors to record in addition to Y, M, C and K).

FIG. 6 shows another prior art apparatus for recording images by heat transfer with a thermal head. The apparatus generally indicated by 120 uses an image-receiving sheet 122 that is not a cut sheet but a continuous web. Being unwound from a supply roll 124, the sheet 122 contacts a platen roller 126 and is wound up by a takeup roll 128. As in the case shown in FIG. 6, an ink sheet 130 is unwound from a supply roll 132, brought into a superposed relationship with the image-receiving sheet 122 on the platen roller 126 and thereafter heated imagewise with a thermal head 134 provided in close proximity to the platen roller 126. Upon heating, the ink layer on the ink sheet 130 melts or sublimes and is transferred onto the image-receiving sheet 122 for image recording. The used ink sheet 130 is wound up by a takeup roll 136. Thereafter, the image-receiving sheet 122 is reversed to the recording start position and the same procedure is repeated for image recording in a next color. This image recording procedure is taken as many times as are required to record three or four colors, thereby forming a full color image.

In both the heat transfer image recording apparatus 100 and 120 shown in FIGS. 5 and 6, respectively, the thermal head 112 or 134 may be replaced by a laser head capable of emitting laser light of high energy density and such a method of recording in a heating mode may also be adopted.

If desired, both the image-receiving sheet and the ink sheet may be cut sheets that are wound onto a recording drum for performing thermal recording. This can be done effectively whether a thermal head or a laser head operating in a heating mode is employed.

A fusion-type thermal transfer image recording apparatus that depends on a laser head operating in a heating mode is described in Unexamined Published Japanese Patent Application (kokai) Hei 5-254188. The apparatus has a hold-down means for preventing the image-receiving and ink sheets from wrinkling or otherwise deforming when they are held by suction on the recording drum, thereby enabling the sheets to be fed and ejected automatically.

The ink sheets 110 and 130 used in the conventional thermal transfer image recording apparatus are either soft-enable to melt the ink or vaporizable to have it sublime. The first type of ink sheets comprises a support carrying a transfer layer (image forming layer) that has a colorant mixed in a binder which is selected from among waxes and other low-melting point substances that will soften or melt upon heating. The second type of ink sheets is characterized by the use of a binder that sublimes upon heating. Hence, the thickness of the transfer layer is at least 5 μm and, sometimes, as great as 20–30 μm irrespective of whether the ink sheets are of the melt or sublimation type. Because of this thickness problem, great energy is required to heat the transfer layer until the ink sublimes or melts, or the image resolution cannot be increased beyond a certain level or small dots cannot be reproduced consistently on account of blurred or jagged edges.

In the conventional method of image recording by heat transfer, the colorant or any other necessary components will readily transfer from the ink sheet to the image-receiving sheet as a result of the melting or sublimation of the transfer layer in the ink sheet and, hence, the ink sheet need only to be brought into intimate contact with the image-receiving sheet without causing wrinkles or other deformations in the prior art models 100 and 120. In addition, the ink sheet and the image-receiving sheet which are merely placed in intimate contact with each other can be readily separated as required. Under these circumstances, no consideration has been given to the means of joining the two sheets with a uniform adhesive force or the means of separating them without causing unevenness.

When bonding the two sheets together by an adhesive force, a displacement or positional effect may occur in the sheets to be joined; alternatively, the image-receiving sheet may be displaced when the ink sheet is peeled therefrom in counteraction against the adhesive force. This problem with the lower precision of registration has not been taken into account in the prior art. The hold-down means used by the image recording apparatus described in Unexamined Published Japanese Patent Application (kokai) Hei 5-254188, supra, merely holds the image-receiving sheet and the ink sheet under their own weight on the recording drum. This is effective in preventing the occurrence of wrinkles but, on the other hand, it is not applicable to the case where there is the need to bond the two sheets together by a uniform adhesive force.

SUMMARY OF THE INVENTION

The present invention has been accomplished under these circumstances and has an object to provide a compact, color image forming apparatus in which a novel, extremely thin and peelable colorant film that is given an imagewise pattern of energy is peeled imagewise from the colorant sheet and transferred to an image-receiving material to form an image on the image-receiving material which is also novel, which apparatus is characterized in that the colorant sheet can be adhered to or peeled from the image-receiving material uniformly without causing failure in registration, particularly without causing unevenness during peeling.

This object of the invention can be attained by a color image forming apparatus that forms an image by imagewise application of thermal energy from a colorant sheet having a peelable, thin colorant film so that said thin colorant film associated with the imagewise applied thermal energy is peeled and transferred onto an image-receiving material adhering to said colorant sheet;

which apparatus has a rotating member for rotationally scanning and transporting said image-receiving material and said colorant sheet that are in contact with the outer circumference of said rotating member, holding means for holding at least said image-receiving material on said rotating member, laminating means for pressing said colorant sheet so that it adheres to the image-receiving material held on said rotating member, recording means for supplying the image-receiving material and the colorant sheet on said rotating member with thermal energy in a direction generally perpendicular to the direction in which said rotating member rotationally scans, and peel/transfer means by which said thin colorant film that has been supplied imagewise with thermal energy from said recording means to have the bonding force lowered is peeled from said colorant sheet and transferred onto said image-receiving material so as to form a monochromatic image thereon;

wherein the process consisting of pressing said colorant sheet by said laminating means so that said colorant sheet adheres to said image-receiving material held on said rotating member, the imagewise application of thermal energy to said colorant sheet by the recording means, as well as the peeling of the thermal energy supplied colorant sheet and the formation of a monochromatic image by said peel/transfer means is repeated for three or four colors so as to form a full color image.

In a preferred embodiment, the peel/transfer means presses the colorant sheet onto the image-receiving material in the area where the former is peeled from the latter.

In another preferred embodiment, the rotating member is a recording drum around which the image-receiving material and the colorant sheet are wound and held in position.

Preferably, the holding means is grip means for gripping the image-receiving material on the recording drum. The image-receiving material is preferably held in position by grip means that grips it in engagement with the recording drum.

In a more preferred embodiment, the holding means comprises grip means for gripping an end of either the image-receiving material or the colorant sheet or both and winding means for winding either the image-receiving material or the colorant sheet or both around the rotating member as either the image-receiving material or the colorant sheet or both are placed under tension with the distal end being gripped.

The image-receiving material is preferably held in position by the combination of the grip means and the winding means.

Preferably, the image-receiving material is placed under a greater tension than is the colorant sheet.

Processing with the color image forming apparatus of the invention proceeds as follows: a colorant sheet having a novel, unconventionally thin and peelable colorant film is adhered to a novel image-receiving material with a uniform adhesive force under heat and/or pressure that is applied by the laminating means; thermal energy is applied imagewise to cause imagewise reduction in the bonding force of the thin colorant film in the colorant sheet, so that the force of bond between the thin colorant film in the colorant sheet and the support (or the light-heat conversion layer) becomes smaller than the force of adhesion between the thin colorant film in the colorant sheet and the image-receiving layer in the image-receiving material, whereby the colorant sheet is peeled from the image-receiving material by the peel/transfer means without causing uneven peeling or displacement of the image-receiving material; the thin colorant film which has experienced the imagewise reduction in the binding force is transferred from the colorant sheet onto the image-receiving layer in the image-receiving material for effecting transfer to form a monochromatic image; this procedure is repeated for three or four colors to produce a full color image. If desired, the image-receiving material to be used in the invention has a peelable image-receiving layer, the color image formed on the image-receiving layer can in turn be transferred from the other part of the image-receiving material onto a final receiving sheet for practical use.

The thus produced full color image is a multi-level image that has high quality and resolution without uneven peeling or failure in registering and it hence has satisfactory characteristics for use as a color proof in the printing area. According to the invention, such high-quality and contrasty images can be produced in an easy and rapid manner using a system more compact than existing models.

DETAILED DESCRIPTION OF THE INVENTION

The color image forming apparatus of the invention will now be described in detail with reference to the preferred embodiments shown in accompanying drawings.

Figure 1:
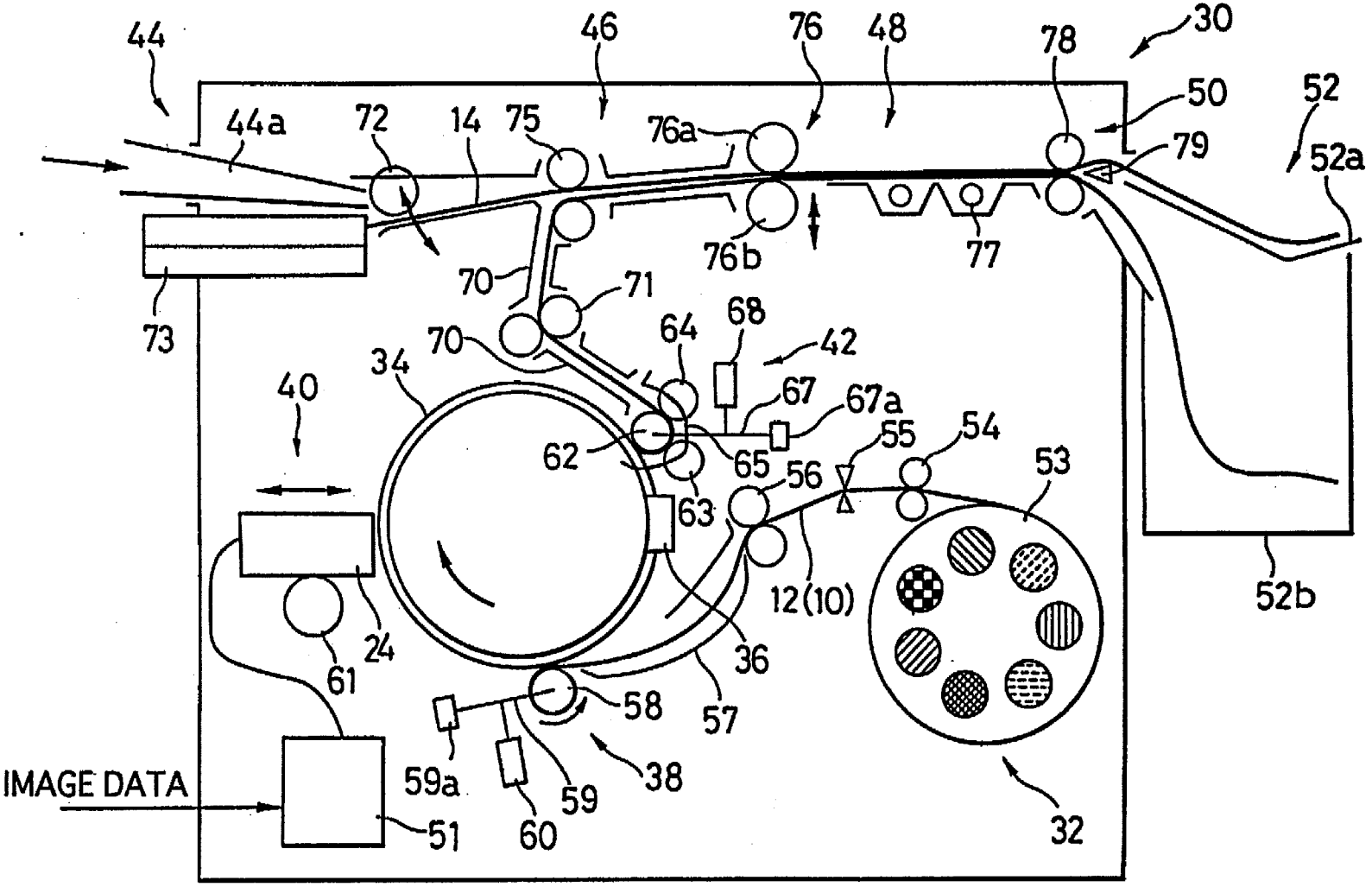
FIG. 1 is a diagrammatic section showing conceptually an embodiment of the color image forming apparatus of the invention.

FIG. 1 is a diagrammatic section of an embodiment of the color image forming apparatus of the invention. Before explaining the color image forming apparatus shown in FIG. 1, we will first describe briefly the color image recording method that is applicable to the color image forming apparatus of the invention with reference to FIG. 3. For details of the compositions and the materials of the colorant sheet and image-receiving material that may be used in the color image forming apparatus of the invention, reference should be made to U.S. Pat. No. 5,352,562 and Japanese Patent Application Hei 5-275749.

FIG. 3 shows conceptually an example of the color image recording process that uses the color image recording method that may be implemented with the color image forming apparatus of the invention.

The color image recording method applicable to the invention is a method of recording images using a colorant sheet 10, an image-receiving material 12 and a final receiving sheet 14 which is a permanent image carrier. The method comprises recording an image onto the colorant sheet 10 and transferring it onto an image-receiving layer 16 in the image-receiving material 12 which in turn is transferred (attached) onto the final receiving sheet 14, thereby producing a hard copy from the receiving sheet 14 that has a color image formed thereon. If printing paper or the like is used as the final receiving sheet 14 in the image recording method just described above, one can produce hard copies that are close to actual prints; in addition, as will be described later in detail, image of high quality that are free from "doubling" can be produced consistently and, hence, the invention is applicable with particular advantage to the preparation of color proofs for use in the printing area.

In the example shown in FIG. 3, the colorant sheet 10 comprises a support 18, a light-heat conversion layer 19 that is formed on the support 18 and which contains a substance capable of conversion from light to heat, a heat release layer 20 formed on the light-heat conversion layer 19 and a thin colorant film 22 (hereunder referred to as a "colorant layer") that is formed on the heat release layer 20 and which contains a pigment such as a toner.

The support 18 works to mechanically support the light-heat conversion layer 19, heat release layer 20 and colorant layer 22. If it is to be illuminated with light such as laser light, the support 18 must have high light transmittance; if high resolution is needed by, for example, shaping the beam of laser light to a spot size of 10 μm or less, the support 18 has preferably a small index of birefringence and may, typically, be formed of polyethylene terephthalate (PET). The thickness of the support 18 is generally in the range from 5 to 300 μm, preferably from 25 to 150 μm.

The light-heat conversion layer 19 serves to absorb the light of high-density energy emitted from a light source such as laser or xenon lamp and convert it to thermal energy; the light-heat conversion layer 19 may be a mixture of a black pigment (e.g. carbon black), an infrared absorbing dye or the like as dispersed in a binder. The thickness of the light-heat conversion layer 19 may typically range from 0.05 to 2 μm, preferably from 0.1 to 1 μm, on average and it has preferably a light absorbance of at least 70%. The light source used as thermal recording means is preferably a laser, more preferably a semiconductor laser such as a laser diode (LD). If a thermal head is used as the thermal heating means, the light-heat conversion layer 19 may be omitted from the colorant sheet 10.

The heat release layer 20, which is present between the colorant layer 22 and the light-heat conversion layer 19 or the support 18 in the absence of illumination with light of high-density energy or in the absence of heat application, serves to bond the two members together. When it receives the heat absorbed by the light-heat conversion layer 19 upon illumination with light of high-density energy or when it receives the heat supplied from the support 18, the heat release layer 20 undergoes a thermal reaction such as a pyrolytic reaction, reducing either the force of its bond to the light-heat conversion layer 19 or the support 18, or the force of its bond to the colorant layer 22, or its cohesive force. The heat release layer 20 may be formed of any suitable materials that have the capability described above and which are selected from among polymers such as nitrocellulose that have comparatively low heat decomposition temperatures and polymers that contain heat-decomposable low-molecular weight compounds. Being formed of these materials, the heat release layer 20 is so designed that it will experience a thermal change at lower temperatures than the light-heat conversion layer 19. The average thickness (deposit weight) of the heat release layer 20 is preferably in the range from 0.03 to 0.3 μm.

The colorant layer 22 comprises a colorant such as dye or pigment that render the image visible and that is mixed with a binder. Both organic and inorganic pigments are used with advantage; when the image recording apparatus of the invention is to be used in printed color proofing, pigment with colors that are identical or close to yellow (Y), magenta (M), cyan (C) and black (K) for incorporation in printing inks are used with particular advantage. These pigments have preferably particle sizes of no more than 1 μm; for high resolution, particle sizes of no more than 0.5 μm are particularly preferred.

In order to insure satisfactory peeling and transfer (development) so that high-quality images are formed, the colorant layer 22 should be comparatively thin and not exceed 5 μm; generally, the thickness of the colorant layer 22 is about 0.1–2 μm, preferably about 0.1–1 μm, more preferably about 0.2–0.4 μm.

Normally, the thus composed colorant sheet 10 has the heat release layer 20 bonded strongly to the colorant layer 22. However, if it is heated directly by thermal recording means such as a thermal head or laser or indirectly by the heat generated as a result of light-to-heat conversion in the light-heat conversion layer 19, a thermal reaction such as a pyrolytic reaction occurs in the heated area of the heat release layer 20 and the force of bonding between the colorant layer 22 and the light-heat conversion layer 19 or the support 18 is reduced so much that only the heated area of the colorant layer 22 will become easily peelable.

Thus, the most characteristic portion of the colorant sheet 10 to be used in the invention is that during transfer, or image formation, the colorant layer 22 will experience no change but that the heat release layer 20 which lowers the force of bonding the colorant layer 22 to the light-heat conversion layer 19 or the support 18 is provided under the colorant layer 22. Because the colorant sheet 10 has this heat release layer 20, the thickness of the colorant layer 22 can be reduced significantly to only about a tenth of the thickness that has been required in the prior art. Improvement is also possible in resolution and particularly great with the use of a laser head; typical data that can be cited are improvements by factors of about 2–13 (300–600 dpi with the use of a thermal head, and 1000–4000 dpi with the use of a laser head). This means that even if the spot size of a laser beam is 10 μm or below, satisfactory image reproduction is possible since the thickness of the colorant layer 22 will in no way exceed 5 μm and typically in the range from 0.1 to 2 μm.

Although not shown, a cover film may optionally be provided on the surface of the colorant layer 22 in the colorant sheet 10 in order to prevent such troubles as damaging of the sheet during its handling or the bonding of film surfaces during storage.

The image-receiving material 12 comprises a support 26, a cushion layer 28 formed on the support 26, and an image-receiving layer 16 formed on the cushion layer 28.

The support 26 is not limited in any particular way as long as it serves to mechanically support the image-receiving layer 16 and the cushion layer 28 and if it is in the form of a film or a plate. The thickness of the support 26, if it is a film, ranges generally from 10 to 400 μm, preferably from 25 to 200 μm.

The cushion layer 28 has sufficient elasticity to absorb the force that is exerted when the colorant sheet 10 and the image-receiving layer 12 are pressed against each other during transfer while enabling sufficiently intimate contact between the colorant layer 22 and the image-receiving layer 16 to confine any dust or dirt that may be present at the interface between these layers. The thickness of the cushion layer 28 having these capabilities is preferably 20–50 μm, most preferably 20–30 μm. The need to confine dust or dirt and absorb the pressing force is particularly great in the case of using a thermal head which will exert high pressure and, hence, the cushion layer 28 may be designed to have a dual structure. On the other hand, the cushion layer 28 may be omitted if a laser head is to be used.

The image-receiving layer 16 serves to receive the colorant layer 22 which is peeled from the colorant sheet 10 when its bonding force has decreased either as a result of exposure in a heating mode or by heating. The image-receiving layer 16 is tacky and capable of receiving 3- or 4-colored images (colorant layer 22); hence, the image-receiving layer 16 is preferably of a nature that allows for variations in thickness. It is preferably a polymer layer formed of an ethylene-vinyl acetate copolymer, an acrylate ester-ethylene copolymer or other polymers that soften at no more than about 80° C. as measured by the Vicat method. To insure transfer onto printing paper as required, the image-receiving layer 16 is preferably made of a photopolymerizable material that can be provided with an appropriate degree of release property after having received 3- or 4-color images.

Such a photopolymerizable image-receiving layer contains at least one polyfunctional vinyl or vinylidene compound capable of forming a photopolymer by addition polymerization, an organic polymeric binder, a photopolymerization initiator and, optionally, an additive such as a thermal polymerization inhibitor.

The image-receiving layer 16 must be capable of deformation for receiving the complete 4-color images, so it need only to have a minimum and sufficient thickness to meet this need. The appropriate thickness of the photopolymerizable substance to be applied varies with the thickness of the color images but is preferably in the range from 1 to 50 μm.

The image-receiving layer 16 may optionally have a dual structure. If image is to be transferred onto a permanent image carrier such as printing paper, an image-receiving layer of a dual structure may be used in such a way that the upper sub-layer is transferred together with the image whereas the lower sub-layer (closer to the support) remains intact on the support.

Before being brought into a superposed relationship with the colorant sheet 10 (see FIG. 3*a*), the image-receiving material 12 has the image-receiving layer 16 covered with a protective sheet 17, which is preferably peeled off and discarded just before the image-receiving material 12 is placed in a superposed relationship with the colorant sheet 10.

The image-receiving layer 16 in the image-receiving material 12 has tackiness. Hence, the heated area of the colorant layer 22 will, upon contact with the image-receiving layer 16, be readily peeled off and transferred onto the latter. The image-receiving layer 16 is also peelable and, hence, if this layer and the final receiving sheet 14 are brought into intimate contact and a superposed relationship, compressed together under heating and separated from each other, the image-receiving layer 16 will be peeled from the cushion layer 28 and transferred onto the final receiving sheet 14.

Figures 3A, 3B, 3C, 3D, 3E, 3F:
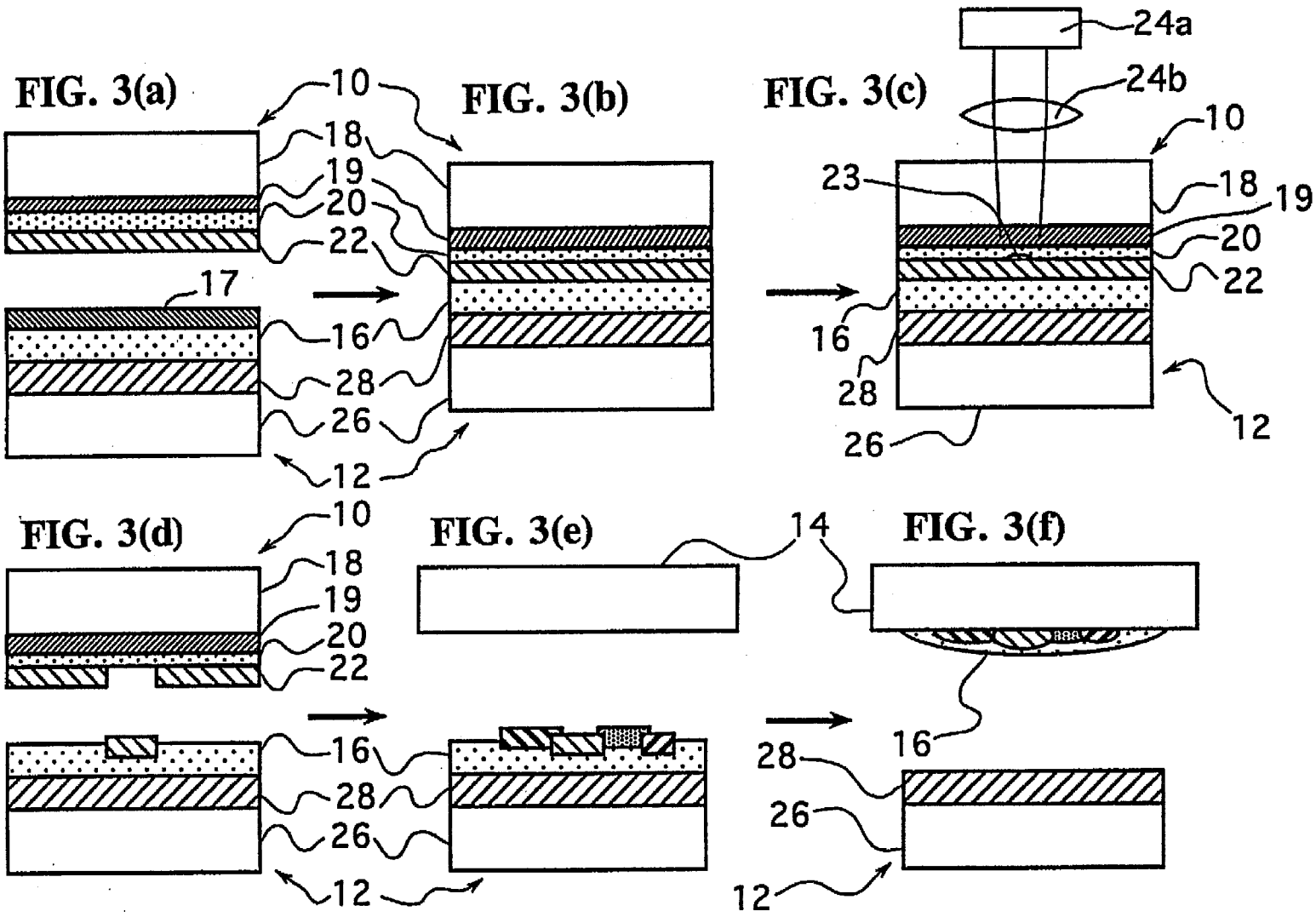
FIG. 3 shows in section and conceptually the image recording process as an example of the image forming method that is applicable to the color image forming apparatus of the invention.

The image recording process shown in FIG. 3 starts with transporting the colorant sheet 10 over the image-receiving material 12 in such a way that the colorant layer 22 faces the image-receiving layer 16 (see FIG. 3*a*); then, the protective sheet 17 is peeled from the image-receiving material 12 and both the colorant sheet 10 and the image-receiving material 12 are brought into a superposed relationship under pressure and heating by laminating means such as heated rollers so that the colorant layer 22 and the image-receiving layer 16 are bonded under a uniform adhesive force (FIG. 3*b*).

Then, a laser head 24 with a laser 24*a* emits laser light which passes through an imaging lens 24*b* to be focused in a smaller beam spot. The colorant sheet 10 is subjected to imagewise exposure by the laser beam in a heating mode from the transparent support 18, whereupon the laser light is converted to heat by the light-heat conversion layer 19 in the colorant sheet 10 and the resulting heat is conducted to the heat release layer 20, whereby a latent image is recorded (FIG. 3*c*). Image recording may be performed by imagewise heating by other suitable thermal recording means such as a thermal head. As a result of this image recording step, the bonding force of the colorant layer 22 provided by the heat release layer 20 in the heated area decreases sufficiently to render the colorant layer 22 readily separable from the light-heat conversion layer 19. Shown by 23 in FIG. 3*c* is the area of the heat release layer 20 that has become low in bonding force as a result of heating.

It should be noted here that the colorant sheet 10 and the image-receiving material 12 may be brought into a superposed relationship (to have the colorant layer 22 adhere to the image-receiving layer 16) by the laminating means solely in the position where image recording is to be done (i.e., the area that is to be irradiated with light of high-density energy such as laser light or that is to be heated under pressure with thermal head) or, alternatively, lamination may be performed across the entire surfaces of the two members.

Subsequently, the image-receiving material 12 is peeled from the colorant sheet 10 for transfer. As mentioned in the previous paragraph, the heated area of the colorant layer 22 in the colorant sheet 10 has become low in the force of bonding to the light-heat conversion layer 19 compared with the force of its adhesion to the image-receiving layer 16 and, hence, that area is readily peelable from the light-heat conversion layer 19. The image-receiving layer 16 is so tacky that if the image-receiving material 12 is peeled from the colorant sheet 10 with pressure being applied by a pressing means such as peel rollers, the non-heated area of the colorant layer 22 is peeled from the image-receiving layer 16 without causing unevenness while, at the same time, the heated area of the colorant layer 22 is transferred onto the image-receiving layer 16, thereby forming an image on the latter. Since the thickness of the colorant layer 22 is comparatively thin (typically 0.1–2 μm and at no times greater than 5 μm), peel/transfer can be accomplished in an accurate and positive manner, thereby assuring the formation of high-quality images without uneven peeling and failure in registration.

When image formation on the image-receiving layer 16 in the image-receiving material 12 is complete for the first color, a colorant sheet for a second color is used and the process of the steps shown in FIGS. 3*a*–3*d* is repeated to form an image of the second color on the image-receiving material 12 by peeling and transfer.

Thus, the images of four colors C, M, Y and K (or three colors C, M and Y, with optional colors that are commonly referred to as "special colors" in the printing area) are produced and transferred onto the image-receiving material 12 (or image-receiving layer 16), thereby forming a full color image. After image formation ends for all colors of interest, the final receiving sheet 14 and the image-receiving material 12 (image-receiving layer 16) are brought into a superposed relationship (laminated) and compressed under heating (FIG. 3*e*) and, then, the final receiving sheet 14 is peeled from the image-receiving material 12 (FIG. 3*f*).

As already mentioned, the image-receiving layer 16 in the image-receiving material 12 is curable by light such as ultraviolet radiation and, hence, peelable. Additionally, the surface of the image-receiving layer 16 is tacky before it cures. Hence, if the image-receiving layer 16, after being adhered to the final receiving sheet 14, is cured and peeled, it will separate from the cushion layer 28 but remain adhering to the final receiving sheet 14, whereby the desired color image is transferred onto the latter.

The color image forming method described above with reference to FIG. 3 is implemented by the color image forming apparatus of the invention, which is shown conceptually in FIG. 1. The color image forming apparatus generally indicated by 30 in FIG. 1 is adapted for producing full color images and comprises a light-sensitive material supply unit 32, an image forming drum 34, a light-sensitive material mount/dismount mechanism 36, a lamination mechanism 38 provided on the circumference of the drum 34, an exposing head 40, a peel mechanism 42, a paper feed unit 44, a lamination unit 46, a fixing unit 48, a peel unit 50, a tray unit 52 and a control unit 51.

Processing with the color image forming apparatus 30 starts with feeding the image receiving material 12 and the colorant sheet 10 from the light-sensitive material supply unit 32 onto the drum 34. The supplied image-receiving material 12 is mounted on the drum 34 by the mount/dismount mechanism 36 and passed through the lamination mechanism 38 which applies a predetermined pressure and heat so that the colorant sheet 10 will adhere to it in a superposed relationship (see FIGS. 3*a* and 3*b*). Then, the exposing head 40 which is controlled by the control unit 54 in accordance with an image signal performs imagewise laser exposure in a heating mode to record a latent image (see FIG. 3*c*). Subsequently, the peel mechanism 42 peels the colorant sheet 10 from the image-receiving material 12 mounted on the drum 34, so that the latent image on the colorant sheet 10 is transferred onto the image-receiving material 12, thereby forming a visible image on the image-receiving material 12 (see FIG. 3*d*). The process of these steps (in FIGS. 3*a*–3*d*) is repeated for 3–4 colors to form a full color image on the image-receiving material 12 (see FIG. 3*e*). Thereafter, the image-receiving material 12 and the final receiving sheet 14 as supplied from the paper feed unit 44 are passed through the lamination unit 46 so that the two members are placed in a superposed and intimate contact relationship, thence passed through the fixing unit 48 so that the image-receiving layer 16 in the image-receiving material 12 is photocured and separated from the other part of the image-receiving material 12 (see FIG. 3*f*). The final receiving sheet 14 now carrying the full color image is ejected onto a proof tray 52*a* whereas the used image-receiving material 12 is ejected into a scrap stacker 52*b*. Thus, the full color image can be obtained as a hard copy.

The light-sensitive material supply unit 32 consists of the following sections: a light-sensitive material station 53 which accommodates rolls of image-receiving material 12 and a plurality of colorant sheets 10 such as rolls of heat-sensitive materials including standard donor sheets for Y (M, C and K, as well as special color sheets used in the printing area) (said rolls of heat-sensitive materials are hereunder referred to simply as "light-sensitive materials"); a pair of withdrawing rolls 54 for withdrawing one light-sensitive material; a cutter 55 with which the light-sensitive material that has been withdrawn in a specified length from the light-sensitive material station 53 by means of the withdrawing rolls 54 is cut to a sheet form; a pair of rollers 56 between which the sheet of light-sensitive material is held for transport; and a guide 57 that directs the sheet of light-sensitive material onto the drum 34 so that its front end is led to the mount position in the light-sensitive material mount/dismount mechanism on the drum 34.

The image forming drum 34 is first supplied with the sheet of image-receiving material 12 (which is hereunder referred to as the "image-receiving sheet"). The front end of the image-receiving sheet is secured to the light-sensitive material mount/dismount mechanism 36 by a suitable means such as a clamp. As the drum rotates in the direction of the arrow, the image-receiving sheet 12 is wound onto the drum 34, with its rear end being also secured by the mechanism 36. In a preferred embodiment, either the front end securing portion of the mechanism 36 or its rear end securing portion or both are adapted to be movable on the outer circumference of the drum 34 so that varying lengths of the light-sensitive sheet can be secured to the drum 34.

After the image-receiving sheet 12 is wound onto the drum 34, the colorant sheet 10 is transported from the supply unit 32 in entirely the same manner and wound in superposition on the image-receiving sheet 12. The colorant sheet 10 is superposed on the image-receiving sheet 12 by means of the laminating mechanism 38 which comprises a laminating roller 58 containing a built-in heater (not shown), an arm 59 that causes the laminating roller 58 to pivot about a fulcrum 59*a* so that it approaches or departs from the outer circumference of the drum 34, and pressing means 60 that presses the laminating roller 58 against the outer circumference of the drum 34 with a specified force. The pressing means 60 may be urging means such as a spring or, alternatively, it may be an air-cylinder manipulator. The image-receiving layer 16 which is on the outermost surface of the image-receiving sheet 12 is sticky, so lamination can be achieved by winding the colorant sheet 10 onto the image-receiving sheet 12 with the specified force of pressure being exerted by the laminating roller 58; hence, the image-receiving layer 16 in the image-receiving sheet 12 can be bonded to the colorant layer 22 in the colorant sheet 10 not only in the absence of wrinkles or other defects in the colorant sheet 10 but also under a uniform adhesive force.

To insure uniform and strong bonding in the case described above, the colorant sheet 10 is laminated onto the image-receiving sheet 12 by means of the laminating pressure roller 58. If a greater adhesive force is desired, it is also preferred to perform lamination with the laminating roller 58 being heated as it applies pressure. Considering the mechanical properties, such as thermal expansion coefficient, of the respective sheets and in view of limitations such as effects on the spot of an exposing laser beam, the temperature for heating the roller 58 is typically 130° C. or less, preferably 100° C. or less. In the illustrated case, the colorant sheet 10 is pressed into a superposed relationship with the image-receiving sheet 12 by means of the laminating roller 58 but this is not the sole case of the invention and any device that is capable of lamination under pressure may be employed, as exemplified by a pressure-urging member in a rod form with a smooth front end.

To wind the image-receiving sheet 12 onto the drum 34, the following method is preferably adopted; the front end of the image-receiving sheet 12 is secured onto the drum 34 by the light-sensitive material mount/dismount mechanism 36 and the other parts of the image-receiving sheet 12 are held by the transport roller pair 56, the laminating roller 58 or some other means and wound onto the drum 34 under a specified tension that is applied to the image-receiving sheet 12. If desired, piercing holes may be provided in the outer circumference of the drum 34 so that the image-receiving sheet 12 can be sucked onto the drum 34 by suction means. The suction means is preferably used in combination with the light-sensitive material mount/dismount mechanism 36 but satisfactory results can be attained even if only one of them is used. In either way, the image-receiving sheet 12 can be secured onto the drum 34 without developing wrinkles or other defects and without causing any displacement. Tension is also preferably applied to the colorant sheet 10 as it is laminated over the image-receiving sheet 12. As in the case of winding the image-receiving sheet 12 around the drum 34, the light-sensitive material mount/dismount mechanism 36 may be employed to secure the front and/or back end of the colorant sheet 10; alternatively, the above-mentioned suction means may be used in combination with the mechanism 36. The tension to be applied to the colorant sheet 10 during lamination is preferably set at a smaller value than the tension that is applied to the image-receiving sheet 12 during its winding onto the drum 34.

The exposing head 40 comprises the laser head 24 and sub-scanning means 61 that performs sub-scanning as it moves parallel to the axis of the drum 34 (in a direction normal to the paper). The laser head 24 comprises basically the laser light source **24*a* that includes modulation means and which emits light of high-density energy such as a laser beam and the imaging lens 24*b*** for adjusting the spot size of the laser beam (see FIG. 3*c*). The colorant sheet 10 is subjected to main scanning with laser light as the drum 34 rotates. In place of the sub-scanning means 61 in the exposing head 40, the drum 34 may be furnished with axially moving means so that it is moved for sub-scanning while it rotationally performs main scanning.

The laser light source may be of any type that is capable of emitting light of sufficiently high-density energy to enable exposure in a heating mode and examples include gas lasers such as an argon ion laser, a helium neon laser and a helium-cadmium laser, solid lasers such as YAG laser and semiconductor lasers, as well as dye lasers and excimer lasers. The laser light that can be used to record images in the present invention may be the light that is directly issued from these lasers or, alternatively, the thus emitted light may be passed through a second harmonic generating device so that its wavelength is halved. A suitable laser light source is selected from among those lasers in consideration of the wavelength at which the colorant sheet 10 is sensitive to laser light, its sensitivity and the required recording speed; semiconductor lasers are the most preferred from the viewpoint of various factors such as cost, output power, size and the ease of modulation.

Modulation of laser light in response to an image signal can be performed by any known techniques; laser, this can be effected in the case of an argon ion by passing the laser beam through an external modulator and in the case of a semiconductor laser, the electric current to be injected into the laser may be controlled by a signal (for direct modulation). The spot size of the laser light to be converged on the light-heat conversion layer and the scan speed are set in accordance with various factors such as the resolution required by images and the recording sensitivity of the materials used. For printing applications, high resolutions are generally required and the smaller beam spot is preferred from the viewpoint of image quality but, on the other hand, the depth of focus will decrease to cause difficulty in mechanical control. If the scan speed is too small, the heat loss due to heat conduction to the support of the heat transfer sheet and the like will increase to lower the energy efficiency; in addition, the recording time is extended. Considering these facts, the following recording conditions may be adopted in the invention: the beam spot size on the light-heat conversion layer is 5–50 μm, preferably 6–30 μm; and the scan speed is at least 1 m/sec, preferably at least 3 m/sec.

Image signals are supplied from external image readers, image processors, workstations (W/S) having the DTP capability, electronic publishing systems and various kinds of memory media (e.g. magnetic tapes, floppy disks, hard disks and RAM cards) and they are interfaced by SCSI and the like to be transmitted to the control unit 51, where they are subjected to the necessary processing and thence transmitted to the exposing head 40 to perform control over the exposure by the laser head 24 in a heating mode. The control unit 51 controls not only the sub-scanning of the exposing head 40 by the auxiliary scanning means 61 and the rotational main scanning by the drum 34, it also controls the various parts of the color image forming apparatus 30 of the invention and the overall sequence of the steps taken by the apparatus.

Figure 2A:
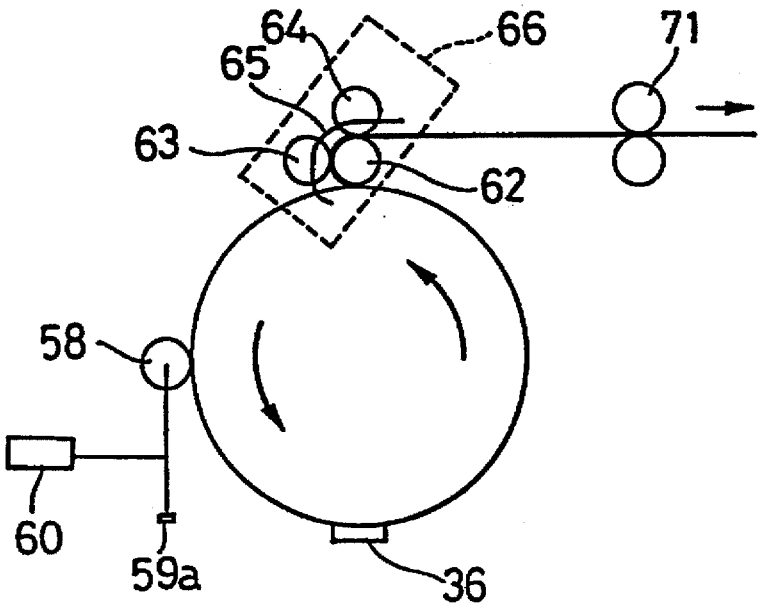
FIG. 2*a* is a schematic sea ion of an embodiment of the peeling mechanism in the color image forming apparatus of the invention.
Figure 2B:
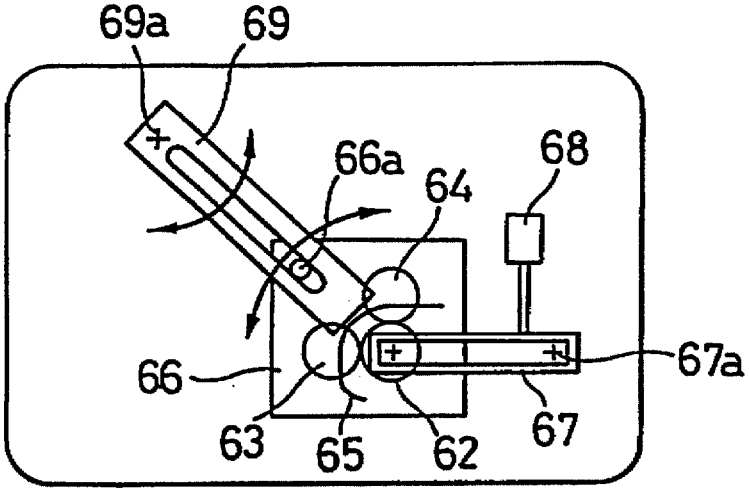
FIG. 2*b* is a schematic section showing enlarged part of FIG. 2*a;*
Figure 2C:
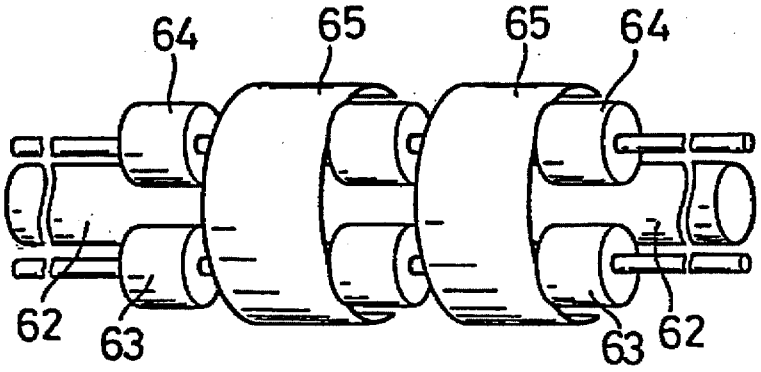
FIG. 2*c* is a general perspective view of the part shown enlarged in FIG. 2*b;*

The peeling mechanism 42 is another characteristic portion of the invention. The colorant sheet 10 that has a latent image formed upon exposure to the exposing head 40 in a heating mode is peeled from the image-receiving sheet 12 by this mechanism 42 while, at the same time, the latent image on the colorant sheet 10 is peeled by this mechanism and transferred onto the image-receiving sheet 12. As shown in FIGS. 2*a*–2*c*, the peeling mechanism 42 comprises a peel roller 62, two segmented rollers 63 and 64 that contact the peel roller 62, comb-toothed guide plates 65 each of which is provided between segments of the rollers 63 and 64 along the peel roller 62, and a bracket 66 in which these parts are mounted as a unitary assembly. The peel roller 62 is axially supported by an arm 67 and pivots about a fulcrum 67*a* so that it can approach or depart from the drum 36. The peel roller 62 is also provided, via the arm 67, with pressing means 68 for pressing the laminate of the image-receiving sheet 12 and the colorant sheet 10 as it is carried on the drum 34. The bracket 66 for supporting the peel roller 62, segmented rollers 63 and 64 and the comb-toothed guide plates 65 has a pin 66*a* and is adapted to be capable of approaching or departing from the outer circumference of the drum 34 under the action of an arm 69 that has a slot in engagement with the pin 66*a* and which pivots about a fulcrum 69*a*.

The colorant sheet 10 which has a latent image formed thereon in response to the decrease in the bonding force of the colorant layer 22 as a result of the imagewise application of thermal energy due to exposure in a heating mode forms a laminate with the image-receiving material 12 having the image-receiving layer 16 which has the colorant sheet 10 bonded thereto. When the arms 67 and 69 pivot about the fulcrums 67*a* and 69*a*, respectively, so that the bracket 66 approaches the laminate and the comb-toothed guide plates 65 are inserted between the image-receiving layer 16 in the image-receiving material 12 and the colorant layer 22 in the colorant sheet 10 while at the same time, the laminate is compressed with the peel roller 62 which is pressed against the colorant sheet 10. If the joining length of either one of the colorant sheet 10 and the image-receiving sheet 12 is made different from that of the other, the comb-toothed guide plates 65 can be easily inserted between the two sheets. Thereafter, the drum 34 is rotated while, at the same time, the peel roller segmented rollers 63 and 64 are also rotated so that the leading end of the colorant sheet 10 is moved along the comb-toothed guide plates 65 to be held between the peel roller 62 and each of the segmented rollers 63. Thus, the colorant sheet 10 is compressed with the peel roller 62 as it is held for transport between the peel roller 62 and each of the segmented rollers 63 and 64, whereby it is peeled from the image-receiving sheet 12. Thus, the colorant sheet 10 can be peeled at a constant speed in the area where it is compressed with the peel roller 62 as a result, the peeling force can be maintained at constant level and neither vibrations such as "stick slip" nor uneven peeling will occur. As a further advantage, the peeling force that is exerted upon the image-receiving material 12 will not vary during the peeling operation and, hence, there will be no offset in the position where the image-receiving material 12 is secured onto the drum 34, nor will there be the possibility of lower precision in registration. Thus, one can produce a monochromatic halftone image that is high in quality, resolution and contrast and which yet is free from defects such as uneven peeling and failure in registration.

After peeling, transfer with exact registration achieved among the images of four colors C, M, Y and K, the image-receiving sheet 12 as guided by guide members 70 are transported by a transport roller pair 71 to the laminating unit 46. In the laminating unit 46, a receiving sheet feed roll 72 delivers the final receiving sheet 14 from a cassette 73 in synchronism with the transport of the image-receiving sheet 12 and the delivered receiving sheet 14 is guided by the guide members 70 so that it is transported toward the left in FIG. 1. If necessary, the receiving sheet 14 may be supplied to the roll 72 via a hand feed inlet 44*a*.

Subsequently, the image-receiving sheet 12 and the final receiving sheet 14 are laminated with registration being achieved by a register roller pair 75, then transported to the fixing unit 48. In the fixing unit 48, the image-receiving material 12 and the final receiving sheet 14 which have been laminated in the laminating unit 46 are thermally fixed with and transported through a thermal fixing roller pair 76 composed of a pressure roller 76*a* and a heating roller 76*b*. The two members are subsequently irradiated with post-exposure lamps 77 such as uv lamps, whereupon the image-receiving layer 16 in the image-receiving sheet 12 hat dens to become readily peelable in the subsequent step.

In the peeling unit 50, the image-receiving layer 16 which has hardened to become easily peelable is separated from the image-receiving sheet 12 by means of a peel roller pair 78 and a peeling guide 79 while, at the same time, the image-receiving layer 16 is attached to the final receiving sheet 14 so that the image is transferred thereto. The final receiving sheet 14 carrying the transferred image is ejected as a hard copy onto the tray unit 52, in particular, the proof tray 52*a*, whereas the image-receiving sheet 12 which has been peeled of the image-receiving layer 16 is discarded into the scrap tray 52*b*.

In the example described above, the image-receiving material (or sheet) 12 is so designed that only the image-receiving layer 16 is peelable. However, this is not the sole case of the invention and another embodiment may be contemplated, in which the image-receiving layer 16 and the cushion layer 28 are rendered to be peelable simultaneously. Thus, the present invention encompasses various embodiments as long as the image-receiving layer 16 is peelable from the support 26.

In the alternative design where the image-receiving layer 16 and the cushion layer 28 (or another intermediate layer) are rendered to be peelable simultaneously, the cushion layer 28 may be formed of a transparent material in order to insure that after both the image-receiving layer 16 and the cushion layer 28 have been transferred onto the final receiving sheet 14, the cushion layer 28 can be used as an image protective sheet. The cushion layer 28 may also serve as the support of a hard copy and, in this case, the final receiving sheet 14 may comprise a transparent sheet that will serve as an image protective sheet.

The color image forming apparatus 30 described on the foregoing pages uses exposing laser head 40 as means for performing thermal energy applied recording but this may be replaced by a thermal head that performs thermal recording onto the colorant sheet 10. In a specific embodiment of this alternative case, a thermal head having a plurality of heating elements that extend along the axis of the drum 34 (in the main scanning direction) may be incorporated in the color image forming apparatus 30 shown in FIG. 1 and the drum 34 is rotated to perform auxiliary scanning for image recording.

Figure 4:
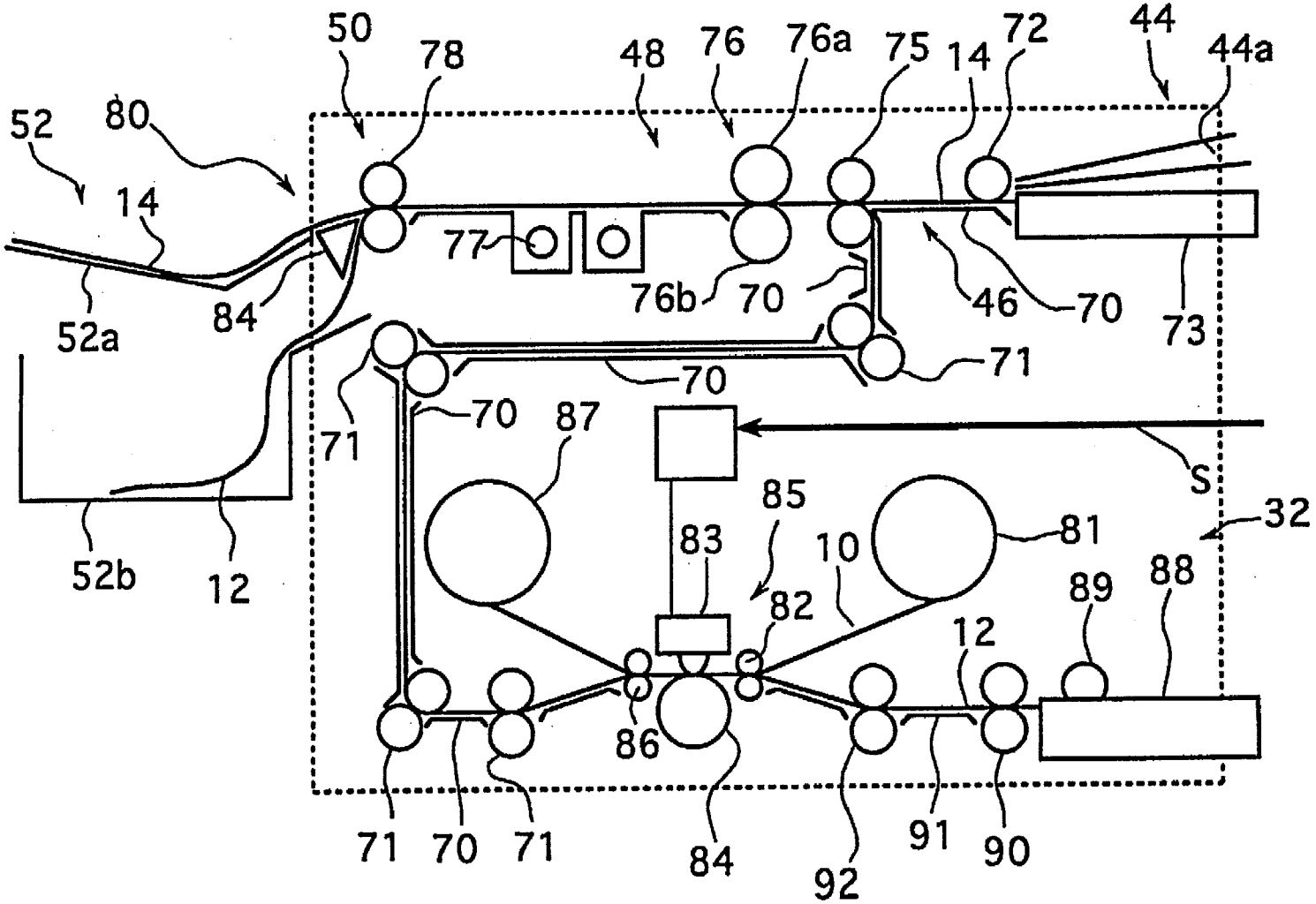
FIG. 4 is a general diagrammatic section showing another embodiment of the color image forming apparatus of the invention.
Figure 5:
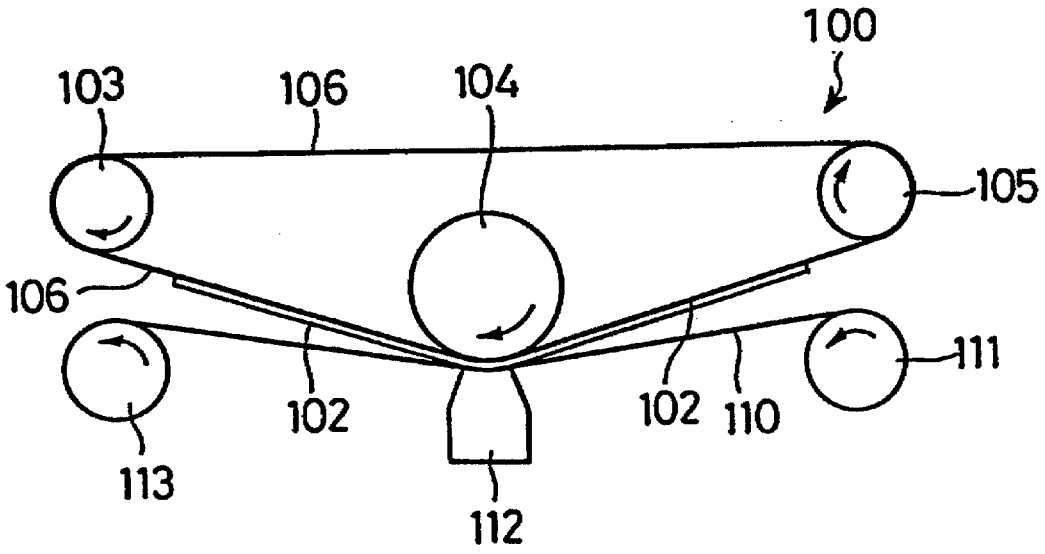
FIG.5 prior art
FIG. 5 is a diagrammatic section of a prior art thermal transfer image forming apparatus.
Figure 6:
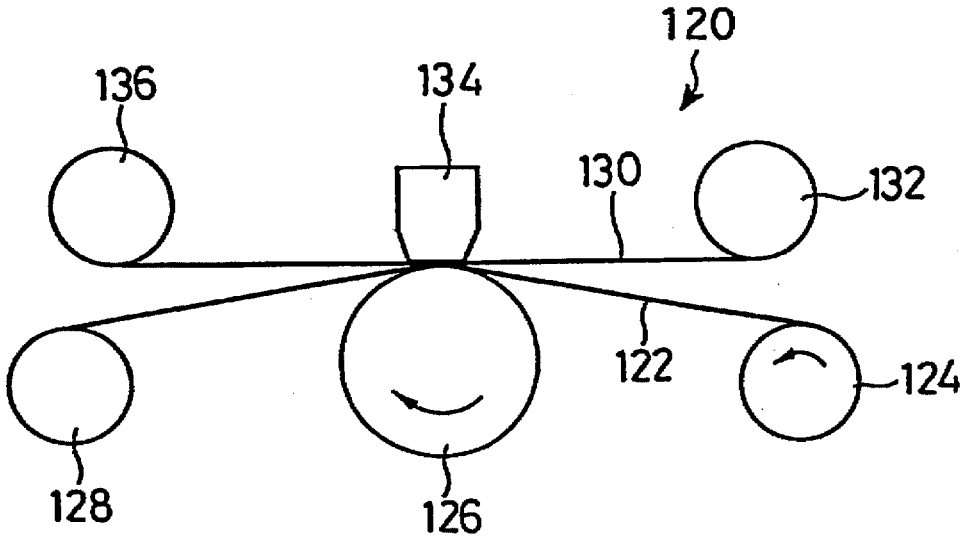
FIG.6 prior art
FIG. 6 is a diagrammatic section of another prior art thermal transfer image forming apparatus.

FIG. 4 shows schematically another embodiment of the color image forming apparatus of the invention, in which a thermal head is used to perform thermal recording. In the color image forming apparatus generally indicated by 80 in FIG. 4, the colorant sheet 10 is a so-called "mottled" colorant sheet comprising an elongated peel of support 18 on which colorant layers 22 of respective colors C, M, Y and K are formed successively in a repetitive way to form one image. Thus, the color sheet 10 provides one color image by one repeating unit of C, M, Y and K.

This colorant sheet 10 is supplied from a feed roll 81, passed through a laminating roller pair 82 so that it is bonded to the image-receiving material 12 under pressure and heating, thence directed through a transfer unit 85 having a thermal head 83 (as thermal recording means) and a platen roller 84 so that image recording, release from the image-receiving material 12 by means of a peel roller pair 86 and transfer development onto the image-receiving material 12, and finally wound onto a takeup roll 87.

The image-receiving material 12 is a sheeting having a length that corresponds to one image. It is contained in a cassette 88, from which it is supplied by means of a delivery roller 89. Being guided with a guide member 91, the image-receiving material 12 is transported by transport roller pairs 90 and 92 to pass through the laminating roller pair 82 so that it is bonded to the colorant sheet 10 under pressure and heating. Thereafter, the laminate is transported to the transfer unit 85 having the platen roller 84 which holds the laminated colorant sheet 10 and the image-receiving material 12 in a predetermined image recording position.

It should be noted here that the image-receiving material 12 to be used in the invention is not limited to a sheet and a continuous web of image-receiving material 12 may be wound onto a roll and subsequently cut by a suitable means such as a cutter provided in the color image forming apparatus 80.

Before the image recording operation starts, the thermal head 83 in the transfer unit 85 is in the upper position and the laminate of the colorant sheet 10 and the image-receiving material 12 is at rest. When the laminate is transported to a predetermined position, the thermal head 83 lowers and the laminate is held between the platen roller 84 and the thermal head 83 under a predetermined pressure so that image recording onto the colorant sheet to by thermal head 83 is started from the predetermined image recording position. As already mentioned, the bonding force of the colorant layer 22 in the colorant sheet 10 decreases upon heating whereas the image-receiving layer 16 in the image-receiving material 12 is sticky and, hence, the colorant layer 22 becomes readily transferable from the other part of the colorant sheet 10 to form a latent image.

The thermal head 83 has a number of tiny heat generating elements arranged in the recording direction perpendicular to the direction of transport (i.e., normal to the paper). Applying this thermal head 83 onto the colorant sheet 10 being transported, image can be recorded onto the entire surface of the colorant sheet 10. The thermal head 83 is connected to the control unit 54 which controls and drives the thermal head 83. The control unit 54 drives or otherwise controls the respective heat generating elements in the thermal head 83 in response to externally forwarded image signals S.

In the image recording position, the laminate of the colorant sheet 10 and the image-receiving material 12 is pressed onto the platen roller 84 by means of the thermal head 83 to effect image recording. Thereafter, the laminate runs downstream of the image recording position (platen roller 84) in the auxiliary scanning direction (the word "downstream" as used hereunder has this particular meaning) and in that "downstream" position, the peel roller pair 86 depresses the laminate so that the colorant sheet 10 is separated from the image-receiving material 12 while, at the same time, the colorant layer 22 which has undergone a drop in the bonding force is transferred to the image-receiving material 12 from the other part of the colorant sheet 10, thereby effecting transfer to form a single-colored image on the image-receiving material 12. Subsequently, the colorant sheet 10 is transported upward by means of the takeup roll 87 whereas the image-receiving material 12 is transported downward by means of a transport roller pair 71.

Thus, in the apparatus shown in FIG. 4, the colorant sheet 10 and the image-receiving material 12 are transported from an upstream to a downstream position in the path connecting the laminating roller pair 82, platen roller 84 and peel roller pair 86 in that order, whereby the respective steps of lamination, recording and peeling which are shown in FIGS. 3*a*–3*d* are performed to form a monochromatic image on the image-receiving material 12.

As already mentioned, the colorant sheet 10 is a mottled colorant sheet having colorant layers 22 of respective colors C, M, Y and K formed in predetermined lengths successively and in a repetitive manner. If the recording of an image of the first color, say, C, and subsequent transfer of that image onto the image-receiving material 12 end, the transport of the colorant sheet 10 and the image-receiving material 12 stops. Then, the thermal head 83 moves to the upper position and one member of each of the laminating roller pair 82 and the peel roller pair 86 shifts in position, whereby the colorant sheet 10 and the image-receiving material 12 in the laminate in the image recording position are disengaged from each other to become separate. Subsequently, the image-receiving material 12 is transported upstream until it stops in a predetermined position where image recording should start. If necessary, the step of registering the colorant sheet 10 may be performed. Thereafter, the recording of an image of a next color, say M, and subsequent transfer of that image onto the image-receiving material 12 are performed by the same procedure.

Similarly, the recording of images of the remaining colors Y and K and the subsequent transfer of those images onto the image-receiving material 12 are performed to complete a four-color image that has been transferred onto the image-receiving material 12.

When the mottled colorant sheet 10 is to be used as in the case just described above, the laminating roller pair 82 and the peel roller pair 86 are preferably located the closest possible to the thermal head 83. If lamination of the colorant sheet 10 and the image-receiving material 12 on the platen roller 84 can be either laminated under pressure and heating or subjected to peeling under compression by means of the thermal head 83 or if it is capable of both, either the laminating roller pair 82 or the peel roller pair 86 or both may be omitted.

When laminating the colorant sheet 10 and the image-receiving material 12, a predetermined tension is preferably applied to both sheets, with the smaller tension being applied to the colorant sheet 10.

While the image recording apparatus of the invention has been described on the following pages with reference to the preferred embodiments, it should be understood that the invention is by no means limited to those particular embodiments and that various improvements and modifications can be made without departing from the spirit and scope of the invention.

As described above in detail, since the image recording method of the present invention comprises laminating under a uniform bonding force a colorant sheet having a peelable, thin colorant film and an image-receiving material having a sticky image-receiving layer, recording an image by application of thermal energy and thereafter peeling, for transfer purpose, the colorant sheet from the image-receiving material without causing unevenness or displacement, it is possible to produce a high-quality and high-resolution color image free from a failure in registering on the image-receiving material. A hard copy of the thus produced color image is particularly useful as a color proof in the printing area.

What is claimed is:

1. A color image forming apparatus that forms an image by imagewise application of thermal energy from a colorant sheet having a peelable, thin colorant film so that said thin colorant film associated with the imagewise applied thermal energy is peeled and transferred onto an image-receiving material adhering to said colorant sheet comprising:

a rotating member for rotationally scanning and transporting said image-receiving material and said colorant sheet that are in contact with the outer circumference of said rotating member;

holding means for holding at least said image-receiving material on said rotating member;

laminating means for pressing said colorant sheet so that it adheres to the image-receiving material held on said rotating member;

recording means for supplying the image-receiving material and the colorant sheet on said rotating member with thermal energy in a direction generally perpendicular to the direction in which said rotating member rotationally scans; and peel/transfer means by which said thin colorant film that has been imagewise supplied with thermal energy from said recording means to have the bonding force lowered is peeled from said colorant sheet and transferred onto said image-receiving material so as to form a monochromatic image thereon.

2. A color image forming apparatus,s according to claim wherein said peel/transfer means includes means for pressing said colorant sheet onto said image-receiving material in the area where the colorant sheet is peeled from the image-receiving material.

3. A color image forming apparatus according to claim 1 or 2 wherein said rotating member is a recording drum around which the image-receiving material and the colorant sheet are wound and held in position.

4. A color image forming apparatus according to claim 3 wherein said holding means includes grip means for gripping said image-receiving material on said recording drum.

5. A color image forming apparatus according to claim 1 or 2 wherein said holding means comprises grip means for gripping an end of at least one of said image-receiving material and said colorant sheet and winding means for winding at least one of said image-receiving material and said colorant sheet around said rotating member as said at least one image-receiving material and said colorant sheet is placed under tension with the distal end gripped.

6. A color image forming apparatus according to claim 5 wherein said image-receiving material is placed under a greater tension than is said colorant sheet.

* * * * *